US010060193B2

(12) United States Patent
Vu

(10) Patent No.: US 10,060,193 B2
(45) Date of Patent: Aug. 28, 2018

(54) LIFT FRAME STORAGE AND DEPLOYMENT

(71) Applicant: Ensco International Incorporated, Wilmington, DE (US)

(72) Inventor: Van Van Vu, Houston, TX (US)

(73) Assignee: Ensco International Incorporated, Wilmington, DE (US)

( * ) Notice: Subject to any disclaimer, the term of this patent is extended or adjusted under 35 U.S.C. 154(b) by 0 days.

(21) Appl. No.: 15/644,061

(22) Filed: Jul. 7, 2017

(65) Prior Publication Data

US 2018/0010398 A1 Jan. 11, 2018

Related U.S. Application Data

(60) Provisional application No. 62/359,570, filed on Jul. 7, 2016.

(51) Int. Cl.

| | |
|---|---|
| ***E21B 15/02*** | (2006.01) |
| ***E21B 19/00*** | (2006.01) |
| ***B63B 35/44*** | (2006.01) |

(52) U.S. Cl.

CPC ..... *E21B 15/02* (2013.01); *B63B 35/4413* (2013.01); *E21B 19/002* (2013.01)

(58) Field of Classification Search

CPC .... E21B 15/02; E21B 19/002; B63B 35/4413
See application file for complete search history.

(56) References Cited

U.S. PATENT DOCUMENTS

| | | | | |
|---|---|---|---|---|
| 4,692,081 | A * | 9/1987 | Bennett | E21B 19/06 211/70.4 |
| 4,708,563 | A * | 11/1987 | Van Den Berg | E21B 19/146 175/52 |
| 7,878,735 | B2 * | 2/2011 | Roodenburg | E21B 19/09 405/169 |
| 8,056,492 | B2 * | 11/2011 | Roodenburg | B63B 23/34 114/268 |
| 8,511,385 | B2 * | 8/2013 | Sorenson | E21B 19/22 166/339 |
| 9,297,220 | B2 * | 3/2016 | Beck | E21B 19/004 |
| 9,574,410 | B2 * | 2/2017 | Soertveit | E21B 19/006 |
| 9,625,057 | B2 * | 4/2017 | Inbona | B63B 35/03 |
| 2001/0025727 | A1 | 10/2001 | Byrt et al. | |
| 2013/0330151 | A1 | 12/2013 | Orgeron | |

(Continued)

FOREIGN PATENT DOCUMENTS

| | | | | |
|---|---|---|---|---|
| GB | 2418684 | A * | 4/2006 | E21B 19/22 |

OTHER PUBLICATIONS

PCT Application No. PCT/US2017/041196 International Search Report and Written Opinion dated Oct. 23, 2017, 14 pgs.

*Primary Examiner* — Matthew R Buck
(74) *Attorney, Agent, or Firm* — Fletcher Yoder, P.C.

(57) ABSTRACT

Techniques and systems to store and deploy a lift frame of an offshore vessel. A device may include a member arm comprising a locking feature configured to couple the member arm to a lift frame of the offshore vessel. The device may also include a base configured to be coupled to a drill floor of the offshore vessel, wherein the base comprises a joint configured to allow for rotation of the member arm and the lift frame from a storage position having a first angle between the member arm and the drill floor and a deployment position having a second angle between the member arm and the drill floor.

20 Claims, 7 Drawing Sheets

(56) References Cited

U.S. PATENT DOCUMENTS

| | | | | |
|---|---|---|---|---|
| 2013/0341088 | A1* | 12/2013 | Gleadowe | E21B 7/124<br>175/5 |
| 2014/0090856 | A1 | 4/2014 | Pratt et al. | |
| 2014/0102803 | A1* | 4/2014 | Storhaug | E21B 7/023<br>175/162 |
| 2014/0345858 | A1 | 11/2014 | Brouwer et al. | |
| 2015/0068726 | A1 | 3/2015 | Vogt | |

* cited by examiner

LIFT FRAME STORAGE AND DEPLOYMENT

CROSS REFERENCE TO RELATED APPLICATIONS

This application is a Non-Provisional application of U.S. Provisional Patent Application No. 62/359,570, entitled "Lift Frame Storage and Deployment", filed Jul. 7, 2016, which is herein incorporated by reference.

BACKGROUND

This section is intended to introduce the reader to various aspects of art that may be related to various aspects of the present disclosure, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

Advances in the petroleum industry have allowed access to oil and gas drilling locations and reservoirs that were previously inaccessible due to technological limitations. To allow for access to these locations, additional equipment has been developed and utilized to permit oil and gas resource owners to successfully drill for these otherwise inaccessible energy resources. For example, coiled tubing equipment may be employed to deploy and retrieve concentric to and from production tubing or casing strings. Coiled tubing equipment and other types of equipment used, for example, in well intervention and drilling applications may be supported via a lift frame.

However, the lift frames described above tend to be large structures that consume a substantial amount of space. Additionally, the lift frames (as well as any equipment fitted thereto) are not always required to be deployed over the wellhead. As such, large amounts of time may be spent in moving the lift frame from a storage position into a working position (e.g., over the wellhead), installing equipment to the lift frame when the lift frame is in the working position to provide, for example, well access to the installed equipment, removing equipment from the lift frame when an operation is complete, and subsequently storing the lift frame. It would be desirable to reduce the amount of time spent in installing and equipping a lift frame for operations, de-equipping the lift frame, and removing the lift frame for storage.

DETAILED DESCRIPTION

Figure 1:
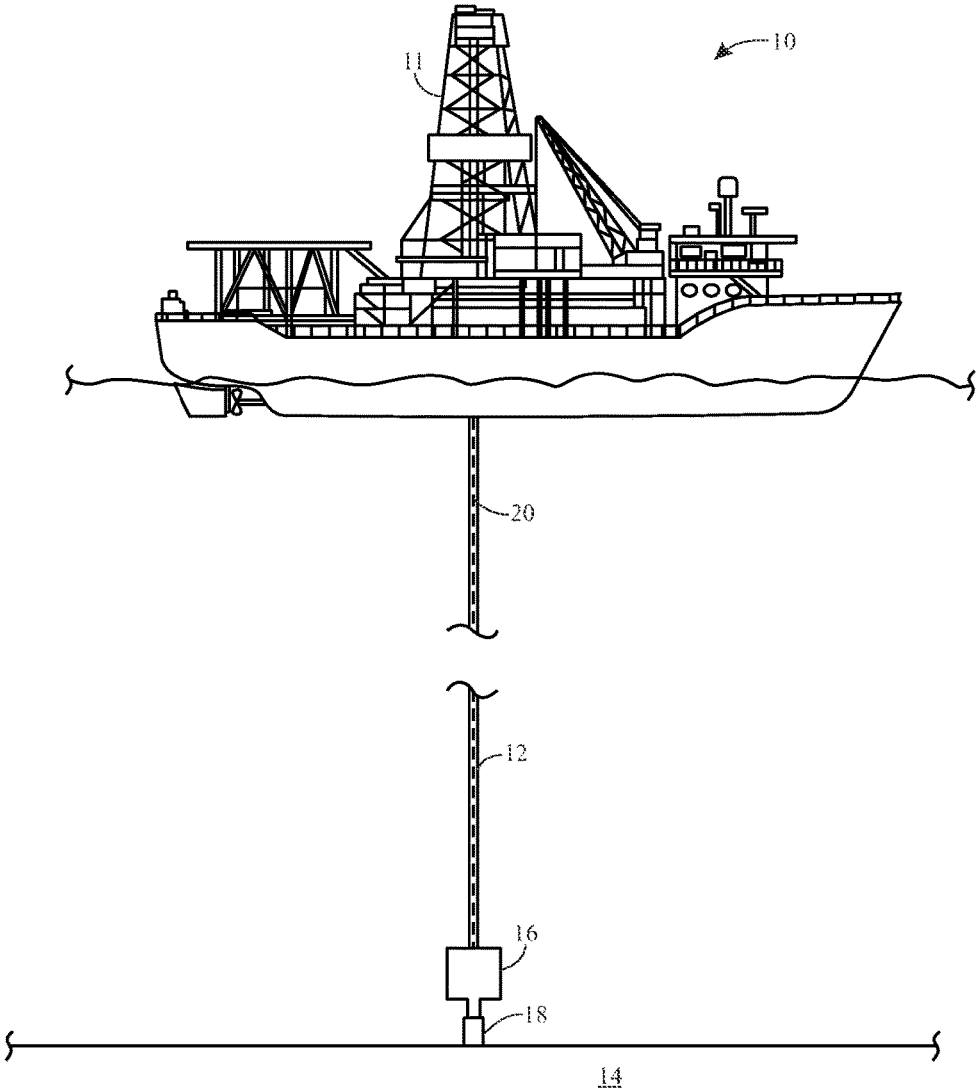
FIG. 1 illustrates an example of an offshore platform having a riser coupled to a wellhead.

One or more specific embodiments will be described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments, the articles "a," "an," "the," and "said" are intended to mean that there are one or more of the elements. The terms "comprising," "including," and "having" are intended to be inclusive and mean that there may be additional elements other than the listed elements.

Systems and techniques for storage and deployment of a lift frame for use in a derrick of an offshore vessel are set forth below. A storage rack may be fitted in the derrick whereby the storage rack allows for vertical oriented storage of the lift frame, inclusive of associated equipment disposed thereon, until such time as the equipment of the lift frame is to be used in operation. A winch with cabling attached to the lift frame may operate in conjunction with (or separate from) one or more mechanical actuators (e.g., hydraulic cylinders or the like) to hold the lift frame and associated equipment in the vertically oriented position in the storage rack during storage of the lift frame and equipment. The storage rack may also include a mechanical bearing, such as a joint, to allow for rotation of member arms of the storage rack with respect to a base of the storage rack. This rotation may be controlled through operation of the mechanical actuators and/or the base in conjunction with the winch to allow the lift frame and associated equipment to move to a deployment position from which a traveling block can be coupled to the lift frame. Locking features (e.g., locking mechanisms) may be removed from the upper arms of the of the storage rack to remove connection points between the storage rack and the lift frame once the traveling block has been coupled to the lift frame, at which time the winch and the traveling block may operate to place the lift frame inclusive of its equipment into position (e.g., over a wellhead) to allow for operation of the equipment. Control of the deployment of the lift frame and associated equipment may be accomplished through the use of a computing system.

Storage of the lift frame and associated equipment in the storage rack once operations by the equipment are complete may also be controlled through the computing system. The winch and traveling block may operate to place the lift frame inclusive of its equipment into the deployment position, at which time the locking features may be utilized to couple the upper arms of the of the storage rack to the lift frame to provide connection points between the storage rack and the lift frame. The traveling block may then be disconnected from the lift frame and the base may operate in conjunction with (or separate from) the one or more mechanical actuators as well as the winch to move the lift frame and associated equipment into the vertically oriented position in the storage rack for storage of the lift frame and equipment. This process and the systems utilized to undertake the process allows for faster storage and deployment of the lift frame and associated equipment relative to traditional techniques, since the multiple steps of placing an empty lift frame in a derrick, equipping the frame, de-equipping the frame, and removing the lift frame from the derrick for each use of the equipment associated with the lift frame can be avoided. Additionally, through vertical oriented storage of the lift frame and associated equipment in the derrick, area on the platform area of the offshore vessel traditionally used to store the lift frame may be freed for other uses.

With the foregoing in mind, FIG. 1 illustrates an offshore platform comprising a drillship 10. Although the presently illustrated embodiment of an offshore platform is a drillship 10 (e.g., a ship equipped with a drill rig and engaged in offshore oil and gas exploration and/or well maintenance or completion work including, but not limited to, casing and tubing installation, subsea tree installations, and well capping), other offshore platforms such as a semi-submersible platform, a spar platform, a floating production system, or the like may be substituted for the drillship 10. Indeed, while the techniques and systems described below are described in conjunction with drillship 10, the techniques and systems are intended to cover at least the additional offshore platforms described above.

As illustrated in FIG. 1, the drillship 10, having a derrick 11 thereon, includes a riser 12 extending therefrom. The riser 12 may include a pipe or a series of pipes that connect the drillship 10 to the seafloor 14 via, for example, blow out preventer (BOP) 16 that is coupled to a wellhead 18 on the seafloor 14. In some embodiments, the riser 12 may transport produced hydrocarbons and/or production materials between the drillship 10 and the wellhead 18, while the BOP 16 may include at least one valve with a sealing element to control wellbore fluid flows. In some embodiments, the riser 12 may pass through an opening (e.g., a moonpool) in the drillship 10 and may be coupled to drilling equipment of the drillship 10. As illustrated in FIG. 1, it may be desirable to have the riser 12 positioned in a vertical orientation between the wellhead 18 and the drillship 10 to allow a drill string made up of drill pipes 20 to pass from the drillship 10 through the BOP 16 and the wellhead 18 and into a wellbore below the wellhead 18.

Figure 2:
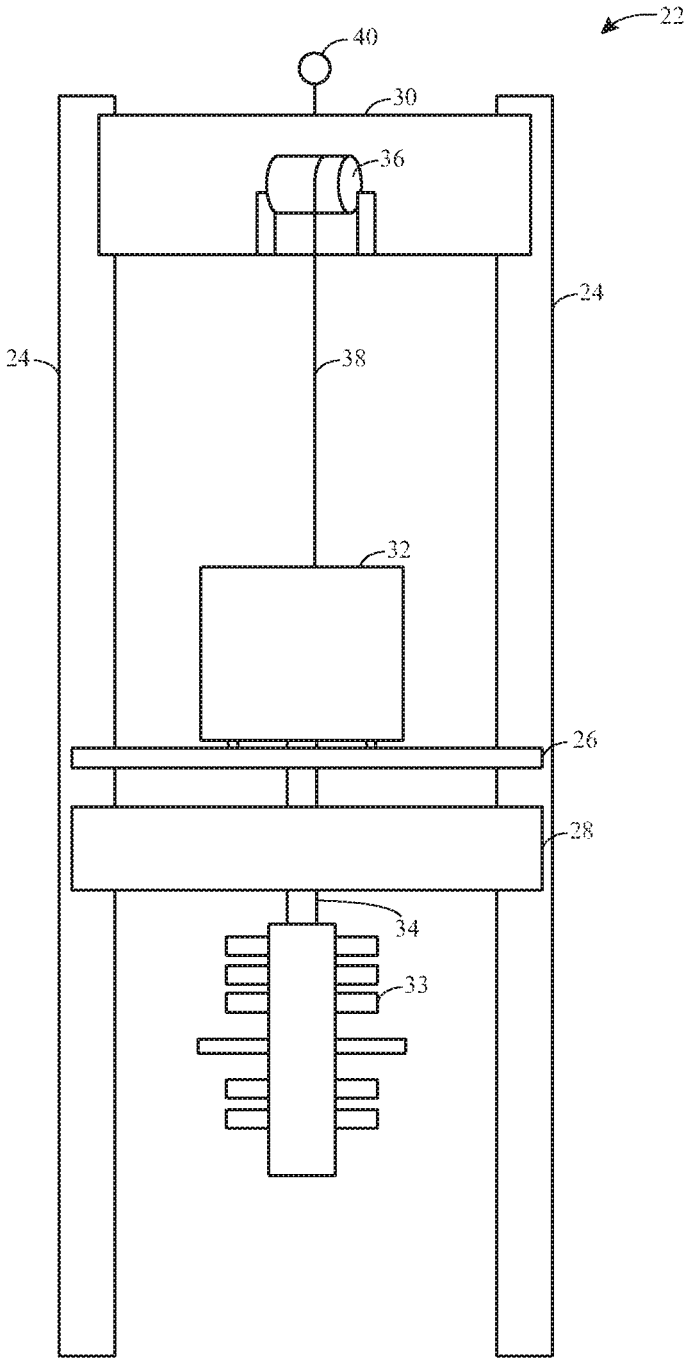
FIG. 2 illustrates a front view of a lift frame and associated equipment for use with the offshore platform of FIG. 1.

During operation of the drillship 10, different equipment may be required to be placed in a location, for example, in the derrick 11 in a position over the wellbore to complete various operational tasks. FIG. 2 illustrates a lift frame 22 that may be utilized to support equipment to allow for the equipment thereon operational access to the wellhead 18 and/or the wellbore beneath the wellhead 18.

Lift frame 22 may be a support structure that supports equipment used in offshore drilling and/or production operations. The lift frame 22 illustrated in FIG. 2 includes outer support beams 24 that may have a platform 26 and support members 28 and 30 coupled therebetween. In some embodiments, the platform 26 and support members 28 and 30 may be positioned at predetermined locations (e.g., at determined heights along the outer support beams) to allow for specific equipment to be added to the lift frame 22. For example, as illustrated in FIG. 2, the lift frame 22 may be utilized in conjunction with coiled tubing equipment. The coiled tubing equipment may include a coiled tubing injector assembly 32 (disposed on platform 26), a well-control stack system 33 (e.g., a BOP), and a riser segment 34 disposed therebetween. However, it should be appreciated that alternative equipment may be associated with and disposed in the lift frame 22. The lift frame 22 may also include a winch system 36 that may be utilized to, for example, extend and retract cabling 38 used to position and/or support the equipment disposed in the lift frame 22 as well as a securing mechanism 40 (e.g., an eye bolt or the like) that allows for the lift frame 22 to be attached to a cable, hook, or the like of, for example, a traveling block for lifting and/or moving of the lift frame 22.

In conventional operations, the lift frame 22 is passed from a storage location on a platform area of the drillship 10 through a v-door of the derrick 11 (e.g., an opening in one side of the derrick 11 that allows for equipment to be lifted into the interior of the derrick 11) and is positioned in an operational location (e.g., over the wellbore beneath the wellhead 18). At that time, the operational equipment (e.g., coiled tubing equipment or the like) is then installed into the lift frame 22 while positioned in its operational location. When all of the operational equipment is installed into the lift frame 22, operations to be performed utilizing the installed lift frame 22 equipment may be undertaken. Once these operations have been completed, the equipment may be removed from the lift frame 22, and the lift frame 22 may be removed through the v-door of the derrick 11 for storage on the platform area of the drillship 10. However, this process of making up and breaking down the lift frame 22 and associated equipment can be cumbersome and time consuming. Accordingly, an alternative system and technique for implementing the lift frame 22 and associated equipment is discussed below in conjunction with FIGS. 3-7.

Figure 3:
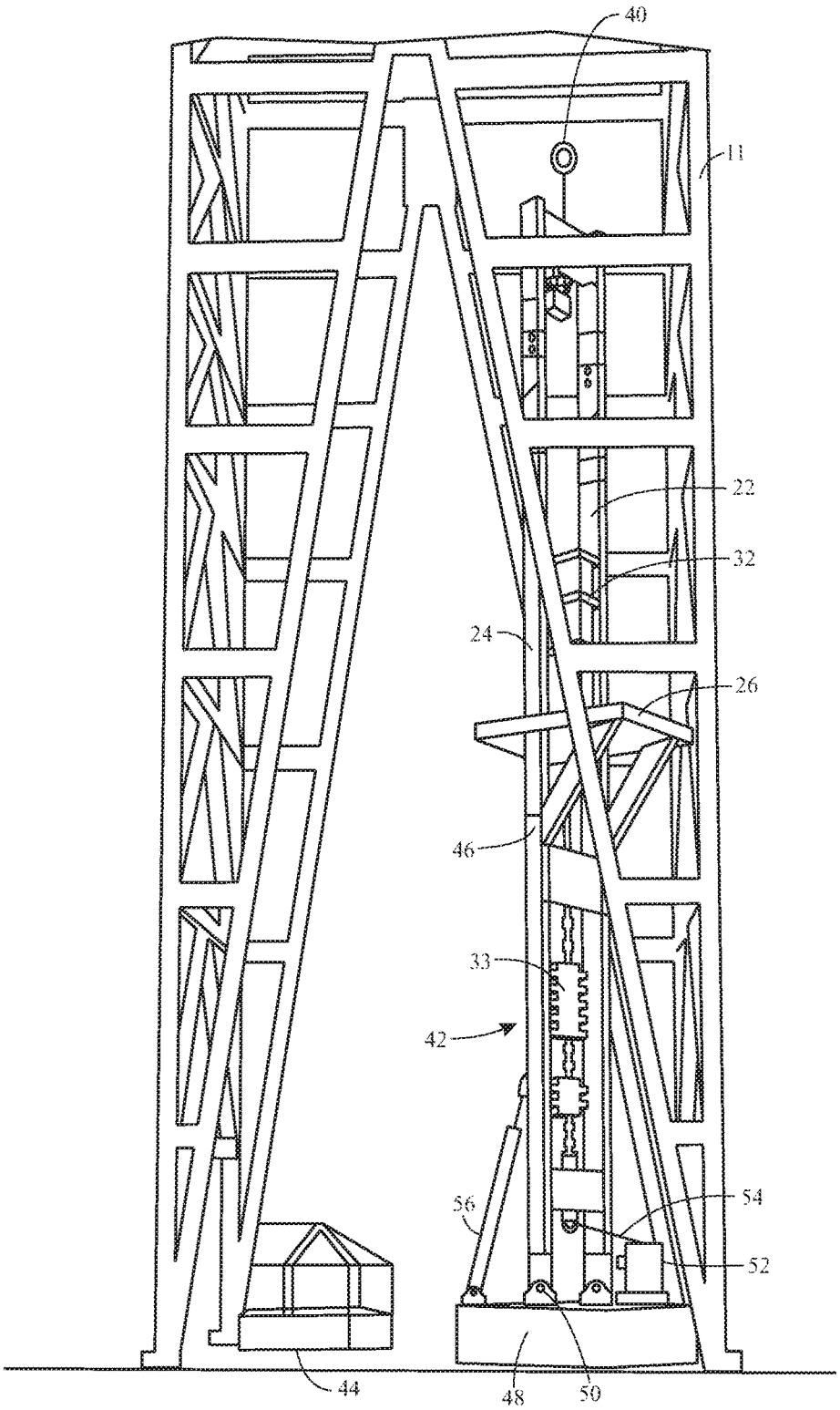
FIG. 3 illustrates a perspective view of the lift frame of FIG. 2 in a storage position in a storage rack in the derrick of the offshore platform of FIG. 1.

FIG. 3 illustrates a storage rack 42 that may be utilized to store the lift frame 22, for example, on a drill floor 44 inside of derrick 11. The storage rack 42 may allow for vertical oriented storage of the lift frame 22 in a storage position, inclusive of associated equipment disposed thereon, until such time as the equipment of the lift frame 22 is to be used in operation. The storage position of the lift frame 22 (and associated equipment) may include the lift frame 22 being stored in the storage rack 42 at an angle of approximately 80°, 85°, 90°, 95°, or 100° with respect to the drill floor 44 or being stored in the storage rack 42 at an angle of between approximately 80°-85°, 85°-90°, 90°-95°, 95°-100°, 80°-90°, 85°-95°, 90°-100°, or 80°-100° with respect to the drill floor 44.

The storage rack 42 may include member arms 46 that may extend along a portion of the outer support beams 24 of the lift frame 22 and provide support for the lift frame 22. The member arms 46 may extend along approximately ¼, ⅓, ½, or ⅔ the length of the outer support beams 24. The storage rack 42 may also include a base 48 that may be coupled to the drill floor 44 and to the member arms 46. The base 48 may be one continuous member that is coupled to each of the member arms 46 or the base 48 may include distinct portions, each of which is coupled to a respective member arm 46. The base 48 may further include a joint 50 (e.g., a pivot or other mechanical bearing) that allows for the member arms 46 to be rotatably coupled to the base 48 (e.g., that allows for an upper portion of the member arms 46 to rotate towards the drill floor 44 while the lowest portion of the member arms 46 that are coupled to the base 48 remain at approximately a fixed distance to the drill floor 44). This joint 50 may allow the storage rack 42 to rotate in a direction towards the drill floor 44 to allow for tilting of the lift frame 22 towards a well center, as will be discussed in greater detail below.

Additional elements may operate in conjunction with the joint 50 to allow for the lift frame 22 (and associated equipment) to be moved from a vertical oriented storage position to a deployment position (in which the lift frame 22 and associated equipment is disposed at an angle of approximately 60°, 65°, 70°, 75°, or 80° with respect to the drill floor 44 or at an angle of between approximately 60°-65°, 65°-70°, 70°-75°, 75°-80°, 60°-70°, 75°-75°, 70°-80°, or 60°-80° with respect to the drill floor 44). For example, a winch 52 may be coupled to the lift frame 22 (e.g., via a cable 54) and may operate to hold at least a bottom portion of the lift frame 22 in desired positions during storage, deployment, and/or operation of the equipment of the lift frame 22 (e.g., by application of consistent force to resist swinging or uncontrolled generally horizontal movement of the bottom portion of the lift frame 22 during movement of the lift frame 22, for example, between a storage position, a deployment position, a raised position, and an operational position). Additionally, for example, one or more mechanical actuators 56 (e.g., hydraulic cylinders, support arms operated by a gear train or motor device, or the like) may be coupled to the support frame 42 and may provide support for the support frame 42 during storage and/or deployment of the lift frame 22 and/or may provide force to move the support frame 42 during deployment of the lift frame 22.

Additional elements may be utilized in conjunction with the operation of the storage rack 42. One such element may be a stopper, which may contact the storage rack 42 when in the storage rack 42 is in a deployment position. This stopper may be, for example, one continuous member coupled to the drill floor 44 and positioned to interface with member arms 46 of the storage rack 42 when the storage rack 42 is in a deployment position. Alternatively, the stopper may be separate members each positioned to interface with a respective member arm 46 of the storage rack 42 when the storage rack 42 is in a deployment position. The stopper may include a face that contacts the member arm 46 (or member arms 46), whereby the face has an angle complimentary to the angle at which the storage rack 42 is positioned in the deployment position. The stopper may operate as a stopping device that provides additional force to resist further rotation of the storage rack 42 when the storage rack 42 is in the deployment position.

Figure 4:
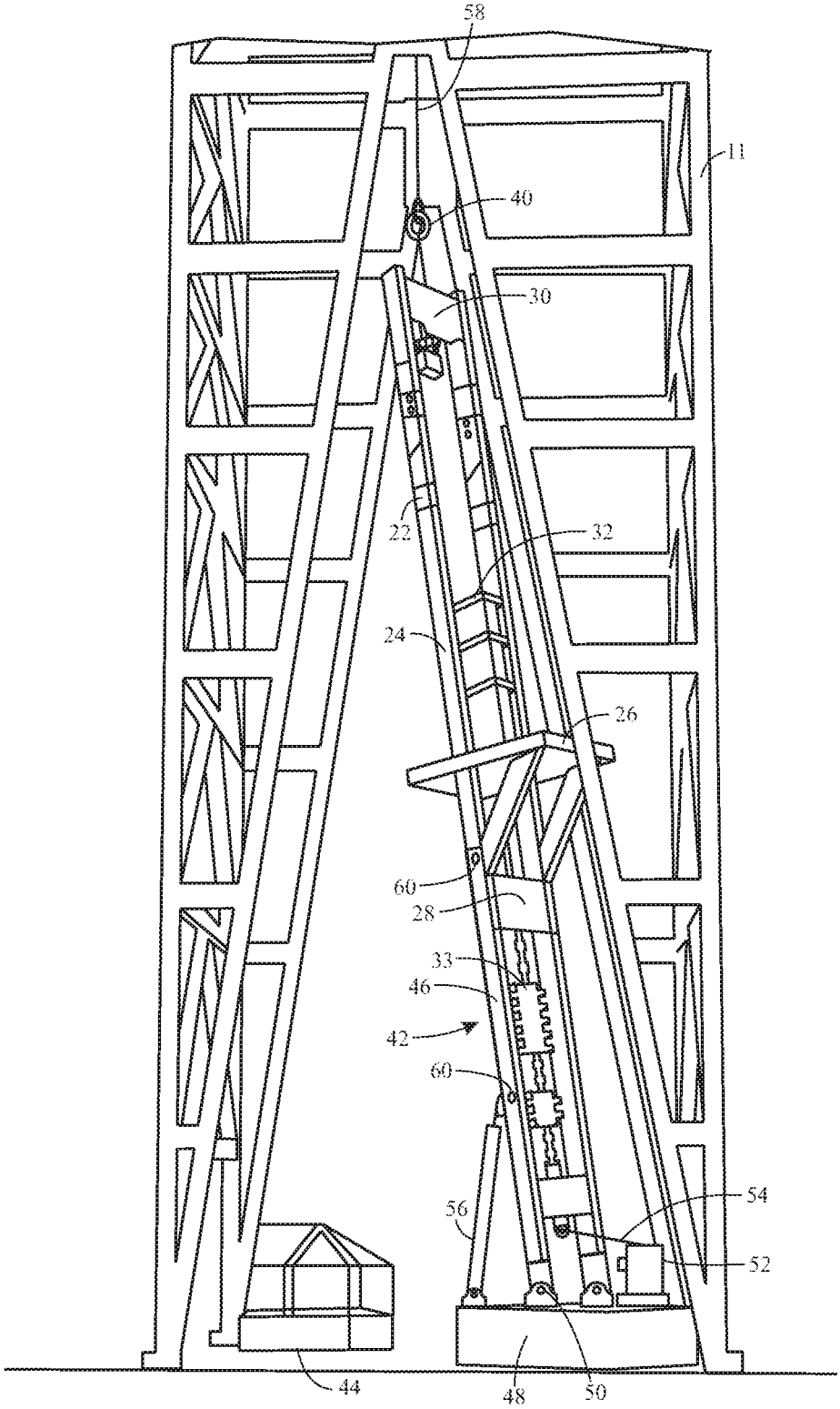
FIG. 4 illustrates a perspective view of the lift frame of FIG. 2 in an extended position in the storage rack of the derrick of the offshore platform of FIG. 1.

FIG. 4 illustrates the storage rack 42 in a deployment position. In the deployment position (in which both the storage rack 42 and the lift frame 22 and associated equipment is disposed at an angle of approximately 60°, 65°, 70°, 75°, or 80° with respect to the drill floor 44 or at an angle of between approximately 60°-65°, 65°-70°, 70°-75°, 75°-80°, 60°-70°, 75°-75°, 70°-80°, or 60°-80° with respect to the drill floor 44), the mechanical actuators 56 may be compressed from an extended position (illustrated in FIG. 3) to the compressed position illustrated in FIG. 4. The mechanical actuators 56 may be active actuators, such that actively controlled compression of the mechanical actuators 56 may operate to move the storage rack 42 from the storage position to the deployment position. Alternatively, the mechanical actuators 56 may be passive actuators, such that one or more other elements (e.g., a motor and/or gear train as part of the base 48 or coupled to the base 48) may operate to move the storage rack 42 from the storage position to the deployment position. Additionally, the mechanical actuators 56 may be active actuators and the base 48 may also actively rotate the storage rack 42 from the storage position to the deployment position in conjunction with one another.

Furthermore, during movement of the storage rack 42 from the storage position to the deployment position, the winch 52 may let out cable 54 at a rate that maintains a consistent force on at least the bottom portion of the lift frame 22. Operation of the winch 52 and movement of the storage rack 42 may be controlled via, for example, a computing system that will be discussed in greater detail below respect to FIG. 7.

Returning to FIG. 4, once the storage rack 42 and the lift frame 22 are moved to the deployment position, a cable 58 may be fastened to the securing mechanism 40. The cable 58 may be coupled to and/or part of, for example, a traveling block and the cable 58 may be deployed and retracted by a drawworks that may operate to lift and/or move the lift frame 22. As the cable 58 is pulled taut by the drawworks, locking features 60 may be disengaged, in some embodiments, as controlled by the computing system. These locking features 60 may include retractable pins, bolts, or the like that extend from an inner surface of the storage rack 42 into apertures of the lift frame 22 and may be retractable into the storage rack 42. Alternatively, the locking features 60 may include clamps that extend about an outer surface of the storage rack 42 and the lift frame 22. Regardless of the configuration utilized, the locking features 60 operate to affix the storage rack 42 to the lift frame 22 both in the storage position and the deployment position of the storage rack 42 and their disengagement allows for the lift frame 22 to be decoupled from the storage rack 42.

Figure 5:
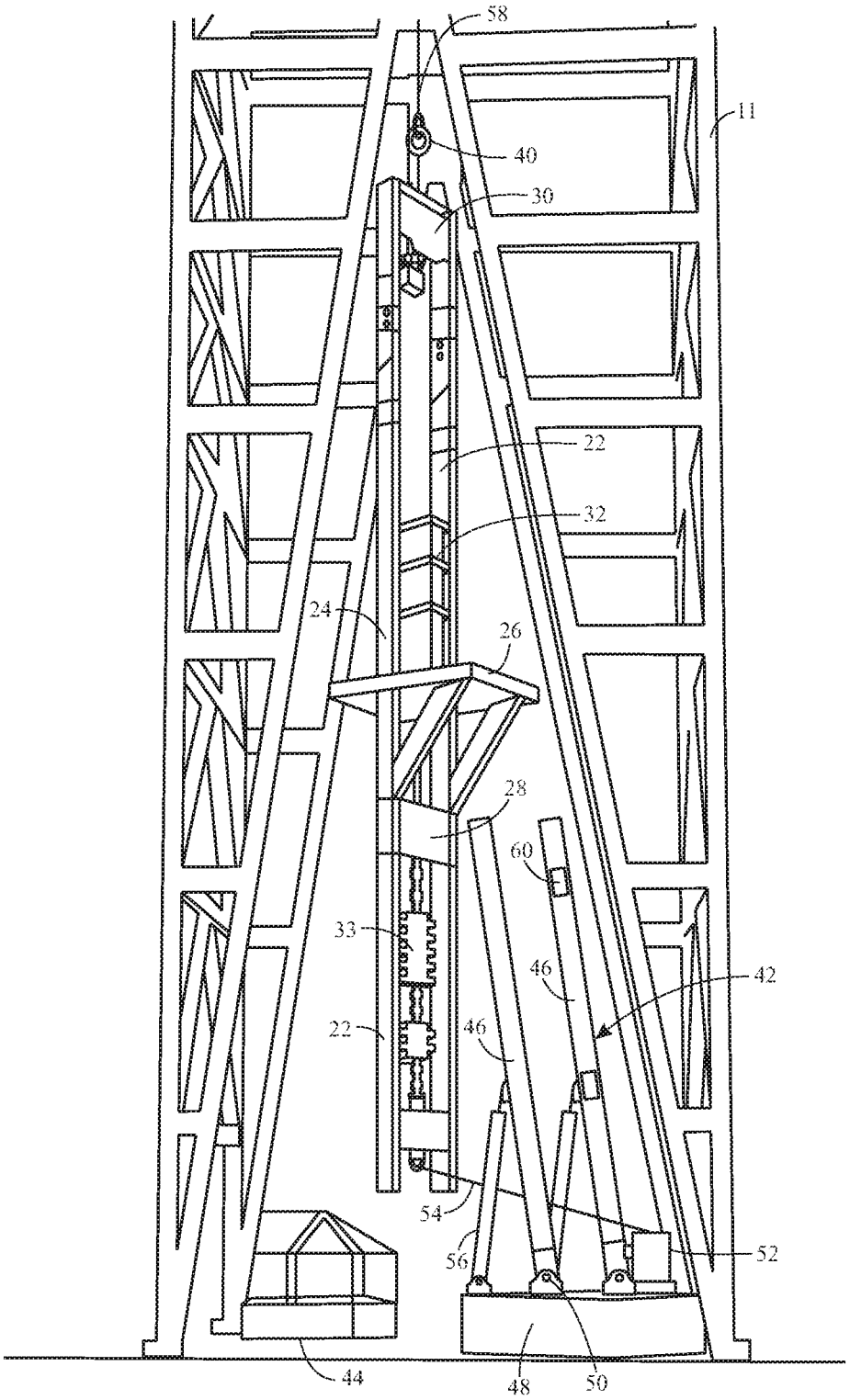
FIG. 5 illustrates a perspective view of the lift frame of FIG. 2 in a lifted position in the storage rack of the derrick of the offshore platform of FIG. 1.

FIG. 5 illustrates the lift frame 22 in a raised position over, for example, the wellhead 18 (e.g., over a center point of a wellbore below wellhead 18) subsequent to being decoupled from the storage rack 42. During movement of the lift frame 22 from the deployment position to the raised position, the winch 52 may let out cable 54 at a rate that maintains a consistent force on at least the bottom portion of the lift frame 22. Operation of the winch 52 (as well as, for example, the drawworks) during movement of the lift frame 22 to the raised position may be controlled via the computing system.

Figure 6:
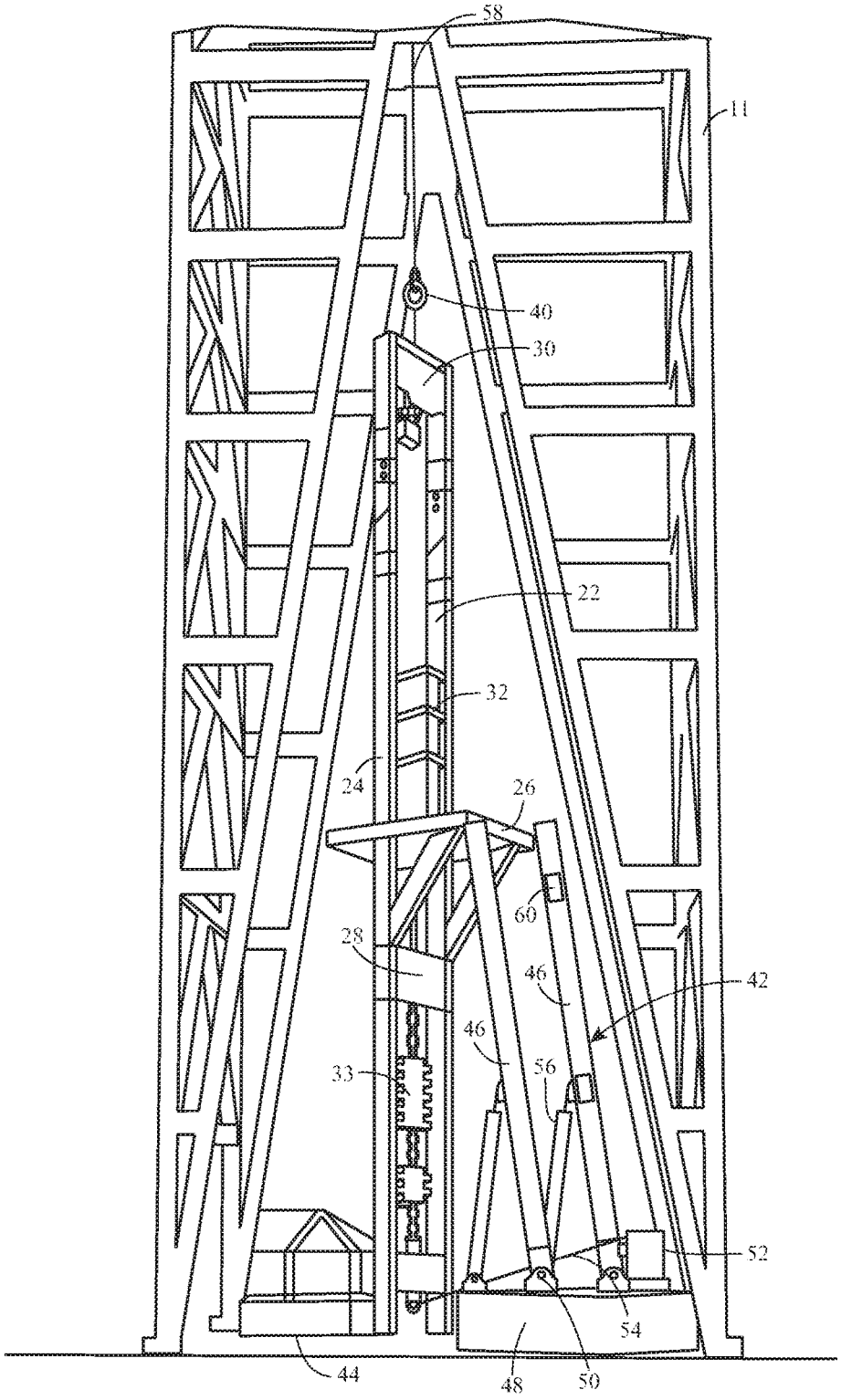
FIG. 6 illustrates a perspective view of the lift frame of FIG. 2 in an operational position in the storage rack of the derrick of the offshore platform of FIG. 1.

Similarly, FIG. 6 illustrates the lift frame 22 in an operational position on the drill floor 44 over, for example, the wellhead 18 (e.g., over a center point of a wellbore below wellhead 18) subsequent to being released from the storage rack 42. During movement of the lift frame 22, from the raised position, the winch 52 may retract and/or deploy cable 54 at a rate that maintains a consistent force on at least the bottom portion of the lift frame 22. Operation of the winch 52 (as well as, for example, the drawworks) during movement of the lift frame 22 to the raised position may be controlled via the computing system.

In some embodiments, the steps described above may be performed in reverse order once operations by the equipment of the lift frame are completed. For example, drawworks may lift the lift frame from the operational position of FIG. 6 to the raised position of FIG. 5. Subsequently, the winch 52 and the drawworks may operate in conjunction to return the lift frame to the deployment position through downwards motion imparted by cable 58 and through retraction of cable 54 by the winch 52 at a rate that provides a consistent force on the bottom portion of the lift frame 22 (e.g., by application of consistent force to resist swinging or uncontrolled generally horizontal movement of the bottom portion of the lift frame 22 during movement of the lift frame 22 from the raised position to the deployment position), as controlled by, for example, the computing system.

Once the lift frame 22 is returned to the deployment position, the locking features 60 may be engaged (controlled by, for example, the computing system) such that the lift frame 22 is coupled to the storage rack 42. The cable 58 may then be disconnected from the securing mechanism 40. Once the lift frame 22 is affixed to the storage rack 42, the storage rack 42 (and, thus, the lift frame 22 and associated equipment) may be moved to the storage position. This movement may be accomplished via the mechanical actuators 56 extending from the compressed position (illustrated in FIG. 4) to an extended position (illustrated in FIG. 3). As previously discussed, the mechanical actuators 56 may be active actuators such that actively controlled extension of the mechanical actuators 56 may operate to move the storage rack 42 from the deployment position to the storage position. Alternatively, the mechanical actuators 56 may be passive actuators such that one or more other elements (e.g., a motor and/or gear train as part of the base 48 or coupled to the base 48) may operate to move the storage rack 42 from the deployment position to the storage position. Additionally, the mechanical actuators 56 may be active actuators and the base 48 may also actively rotate the storage rack 42 from the deployment position to the storage position in conjunction with one another.

During movement of the storage rack 42 from the deployment position to the storage position, the winch 52 may retract cable 54 at a rate that maintains a consistent force on at least the bottom portion of the lift frame 22. Operation of the winch 52 and movement of the storage rack 42 may be controlled, for example, via the computing system discussed below FIG. 7.

Figure 7:
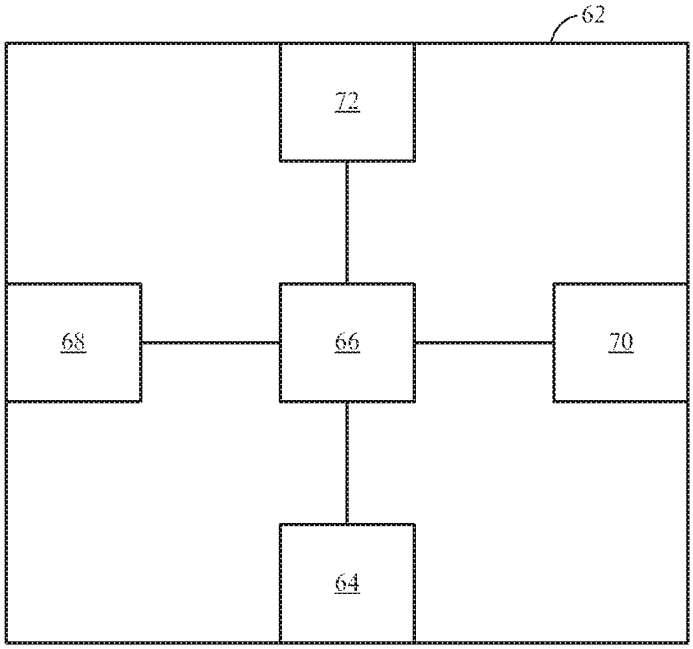
FIG. 7 illustrates a block diagram of a computing system used in conjunction with the storage rack of FIGS. 2-6.

FIG. 7 illustrates the computing system 62. It should be noted that the computing system 62 of drillship 10 may operate in conjunction with software systems implemented as computer executable instructions stored in a non-transitory machine readable medium of computing system 62, such as memory 64, a hard disk drive, or other short term and/or long term storage. Particularly, the techniques to control the movement of the storage rack 42 between the storage position and the deployment position, the techniques to control the winch 52, techniques to control the locking features 60, and techniques to move the lift frame 22 between the deployment position, the raised position, and the operational position may be performed using code or instructions stored in a non-transitory machine readable medium of computing system 62 and may be executed, for example, by one or more processors 66 or a controller of computing system 62. Accordingly, computing system 62 may include an application specific integrated circuit (ASIC), one or more processors 66, or another processing device that interacts with one or more tangible, non-transitory, machine-readable media of computing system 62 that collectively stores instructions executable by a processing device of the computing system 62 to generate, for example, control signals to be transmitted to, for example, one or more of the base 48, the winch 52, the mechanical actuators 56, the locking features 60, and/or the drawworks to cause the steps and actions described above to be performed. By way of example, such machine-readable media can comprise RAM, ROM, EPROM, EEPROM, CD-ROM or other optical disk storage, magnetic disk storage or other magnetic storage devices, or any other medium which can be used to carry or store desired program code in the form of machine-executable instructions or data structures and which can be accessed by the processor 90 or by any general purpose or special purpose computer or other machine with a processor 90.

The computing system 62 may include a processor 66 that may be operably coupled with the memory 64 to perform various algorithms. Such programs or instructions executed by the processor(s) 66 may be stored in any suitable article of manufacture that includes one or more tangible, computer-readable media at least collectively storing the instructions or routines, such as the memory 64. Additionally, the computing system 64 may optionally include a display 68, which may be a liquid crystal display (LCD) or other type of display, and allows users to view images generated by the computing system 62. The display 68 may include a touch screen, which may allow users to interact with a user interface of the computing system 62.

The computing system 62 may also include one or more input structures 70 (e.g., a keypad, mouse, touchpad, one or more switches, buttons, or the like) to allow a user to interact with the computing system 62, for example, to start, control, or operate a GUI or applications running on the computing system 62 and/or to start, control, or operate the techniques to move the storage rack 42 between the storage position and the deployment position, as well as the techniques to control the winch 52, techniques to control the locking features 60, and techniques to move the lift frame 22 between the deployment position, the raised position, and the operational position. Additionally, the computing system 62 may include network interface 72 to allow the computing system 62 to interface with various other electronic devices. The network interface 72 may include a Bluetooth interface, a local area network (LAN) or wireless local area network (WLAN) interface, an Ethernet connection, or the like. The computer system 62, which may be a stand-alone unit, for example, adjacent to the derrick 11 or may be part of a larger control system of the drillship 10, may be utilized to control the process and system for faster storage and deployment of the lift frame 22 and associated equipment relative to traditional techniques.

This written description uses examples to disclose the above description to enable any person skilled in the art to practice the disclosure, including making and using any devices or systems and performing any incorporated methods. The patentable scope of the disclosure is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims. Accordingly, while the above disclosed embodiments may be susceptible to various modifications and alternative forms, specific embodiments have been shown by way of example in the drawings and have been described in detail herein. However, it should be understood that the embodiments are not intended to be limited to the particular forms disclosed. Rather, the disclosed embodiment are to cover all modifications, equivalents, and alternatives falling within the spirit and scope of the embodiments as defined by the following appended claims.

What is claimed is:

1. A device, comprising:

a member arm comprising a releasable locking feature configured to couple the member arm to a lift frame of an offshore vessel; and a base configured to be coupled to a drill floor of the offshore vessel, wherein the base comprises a joint configured to allow for rotation of the member arm and the lift frame between a storage position having a first angle between the member arm and the drill floor and a deployment position having a second angle between the member arm and the drill floor, wherein the releasable locking feature is configured to disengage to decouple the lift frame from the member arm once the member arm and the lift frame are in the deployment position, wherein the releasable locking feature is configured to engage to couple the lift frame to the member arm into the deployment position from a raised position of the lift frame.

2. The device of claim 1, wherein the member arm is configured to support the lift frame at an angle of approximately 90° with respect to the drill floor as the first angle.

3. The device of claim 1, wherein the member arm is configured to support the lift frame at an angle of approximately 80° with respect to the drill floor as the second angle.

4. The device of claim 1, comprising a second member arm comprising a second releasable locking feature configured to couple the second member arm to the lift frame.

5. The device of claim 1, wherein the member arm extends along a partial length of the lift frame.

6. The device of claim 1, comprising a mechanical actuator configured to apply a pressure to the member arm in the storage position.

7. The device of claim 1, comprising a mechanical actuator configured to apply a pressure to the member arm in the deployment position.

8. The device of claim 7, wherein the mechanical actuator is configured to apply a second pressure to the member arm in the storage position.

9. The device of claim 1, comprising a stopper configured to apply a pressure to the member arm when the member arm is disposed in the deployment position.

10. The device of claim 1, wherein the member arm and the base are sized to be enclosed within a derrick of the offshore vessel concurrently.

11. A system, comprising:

a storage rack configured to be coupled to a lift frame of an offshore vessel;

a winch configured to be coupled to a bottom portion of the lift frame; and a mechanical actuator configured to cause the storage rack and the lift frame to move between a vertical storage position having a first angle between the storage rack and a drill floor of the offshore vessel and a deployment position having a second angle between the storage rack and the drill floor.

12. The system of claim 11, wherein the winch is configured to provide a resistance force to the lift frame when the lift frame is decoupled from the storage rack.

13. The system of claim 11, wherein the winch is configured to provide a retraction force to move the bottom portion of the lift frame from a first vertical position over the drill floor to the deployment position.

14. The system of claim 11, comprising a computing system configured to control operation of the winch.

15. The system of claim 14, wherein the computing system is configured to control operation of the mechanical actuator.

16. The system of claim 14, wherein the storage rack and the lift frame are sized to be enclosed within a derrick of the offshore vessel concurrently.

17. A non-transitory computer-readable medium having computer executable code stored thereon, the code comprising instructions to cause a processor to generate control signals to:

rotate a storage rack coupled to a lift frame of an offshore vessel from a vertical storage position having a first angle between the storage rack and a drill floor of the offshore vessel to a non-vertical deployment position having a second angle between the storage rack and the drill floor, wherein the second angle comprises a different angle than the first angle; and actuate a locking mechanism to decouple the lift frame from the storage rack while the storage rack is in the non-vertical deployment position.

18. The non-transitory computer-readable medium of claim 17, comprising instructions to cause the processor to generate control signals to actuate a mechanical actuator to facilitate the rotation of the storage rack from the vertical storage position to the deployment position.

19. The non-transitory computer-readable medium of claim 17, comprising instructions to cause the processor to generate control signals to actuate the locking mechanism to couple the lift frame from the storage rack at a time subsequent to decoupling of the lift frame from the storage rack.

20. The non-transitory computer-readable medium of claim 17, comprising instructions to cause the processor to generate control signals to rotate the storage rack coupled to the lift frame from the deployment position to the vertical storage position.

* * * * *